US008801270B2

(12) United States Patent
Helfer et al.

(10) Patent No.: US 8,801,270 B2
(45) Date of Patent: Aug. 12, 2014

(54) TIMEPIECE WITH PERMANENTLY COUPLED OSCILLATORS

(75) Inventors: Jean-Luc Helfer, Bienne (CH); Thierry Hessler, St-Aubin (CH); Thierry Conus, Lengnau (CH)

(73) Assignee: The Swatch Group Research and Development Ltd., Marin (CH)

( * ) Notice: Subject to any disclaimer, the term of this patent is extended or adjusted under 35 U.S.C. 154(b) by 66 days.

(21) Appl. No.: 13/609,943

(22) Filed: Sep. 11, 2012

(65) Prior Publication Data

US 2013/0070572 A1 Mar. 21, 2013

(30) Foreign Application Priority Data

Sep. 15, 2011 (EP) ..... 11181508

(51) Int. Cl.
*G04B 17/00* (2006.01)

(52) U.S. Cl.
USPC ..... 368/168

(58) Field of Classification Search
CPC ..... G04B 17/26; G04B 17/06; G04B 17/20; G04F 7/08
USPC ..... 368/168–178, 127–133
See application file for complete search history.

(56) References Cited

U.S. PATENT DOCUMENTS

| | | | | |
|---|---|---|---|---|
| 7,350,966 | B2 * | 4/2008 | Zaugg | 368/140 |
| 7,527,423 | B2 * | 5/2009 | Ruchonnet et al. | 368/127 |
| 2010/0002548 | A1 | 1/2010 | Hessler et al. | |
| 2010/0214879 | A1 | 8/2010 | Lechot et al. | |

FOREIGN PATENT DOCUMENTS

| | | | |
|---|---|---|---|
| CH | 697 523 | B1 | 11/2008 |
| EP | 2 141 555 | A1 | 1/2010 |
| EP | 2 221 676 | A1 | 8/2010 |

OTHER PUBLICATIONS

U.S. Appl. No. 13/609,786, filed Sep. 11, 2012, Helfer, et al.
U.S. Appl. No. 13/610,024, filed Sep. 11, 2012, Sarchi, et al.
European Search Report issued Apr. 26, 2012 in corresponding European Application No. 11 18 1508 filed on Sep. 15, 2011 (with an English Translation).

* cited by examiner

*Primary Examiner* — Edwin A. Leon
(74) *Attorney, Agent, or Firm* — Oblon, Spivak, McClelland, Maier & Neustadt, L.L.P.

(57) ABSTRACT

A timepiece includes a first resonator oscillator oscillating at a first frequency and connected by a first gear train to an energy source and a second oscillator oscillating at a second frequency and connected to a second gear train. The second gear train is connected to the first gear train by an elastic coupling device, in order to synchronize the rate of the two oscillators using the same energy source.

16 Claims, 3 Drawing Sheets

TIMEPIECE WITH PERMANENTLY COUPLED OSCILLATORS

This application claims priority from European Patent Application No. 11181508.0 filed Sep. 15, 2011, the entire disclosure of which is incorporated herein by reference.

FIELD OF THE INVENTION

The invention relates to a timepiece with permanently coupled oscillators and a timepiece of this type comprising two oscillators intended to display at least one value less than or equal to a second with better resolution and/or better precision.

BACKGROUND OF THE INVENTION

It is known to form timepieces with increased frequency in order to improve resolution. However, these timepieces may be very shock sensitive or high energy consumers, which prevents them from becoming common.

It is therefore clear that it is easier to manufacture a calibre by mounting a low frequency oscillator, typically 4 Hz, to display the time and another high frequency oscillator, typically 10 or 50 Hz, which is independent from the first, to display a measured time with improved resolution. However, after several seconds, it is observed that the seconds display of the two oscillators is no longer the same, which may make the quality of the timepiece appear dubious.

SUMMARY OF THE INVENTION

It is an object of the present invention to overcome all or part of the aforementioned drawbacks by proposing a timepiece capable of displaying the time with better resolution, while ensuring the usual robustness of a mechanical watch, reduced energy consumption and minimum drift between the oscillators.

The invention therefore relates to a timepiece comprising a first oscillator oscillating at a first frequency and connected by a first gear train to an energy source and a second oscillator oscillating at a second frequency and connected to a second gear train, characterized in that the second gear train is connected to the first gear train by an elastic coupling means in order to synchronise the rate of the two oscillators using the same energy source.

It is therefore clear that, in the event of shocks, rate variations will be minimal owing to the construction which allows the two oscillators to be synchronised. Consequently, the timepiece according to the invention is capable of displaying the time with better resolution and/or better precision while ensuring a high level of robustness, low power consumption and minimal drift between the gear trains.

In accordance with other advantageous features of the invention:

- the elastic coupling means is formed by a spring connecting one wheel of the first gear train to another wheel of the second gear train;
- the elastic coupling means connects the fourth wheels respectively of the first gear train and the second gear train;
- the oscillator selected as the reference receives the most torque from the energy source and, preferably, at least 75% of the torque;
- the oscillator selected as the reference has better quality isochronism than the other oscillator to facilitate synchronisation of said other oscillator;

- the oscillator selected as the reference has a higher quality factor than the other oscillator;
- said other oscillator has a quality factor of less than 100 so as to obtain more rapid stabilisation;
- the first and second frequencies are identical and preferably higher than 5 Hz to display the time with better resolution and/or better precision;
- the first frequency is different from the second frequency to change the resolution and/or improve precision and, preferably, one of the two frequencies is at least equal to 10 Hz and the other frequency is between 1 and 5 Hz;
- the oscillator selected as the reference is the first oscillator or the second oscillator;
- the timepiece includes a disconnectable chronograph system integral with one of the gear trains;
- the timepiece includes a display with a value lower than a second, permanently or non-permanently secured to one of the gear trains.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

Figure 1:
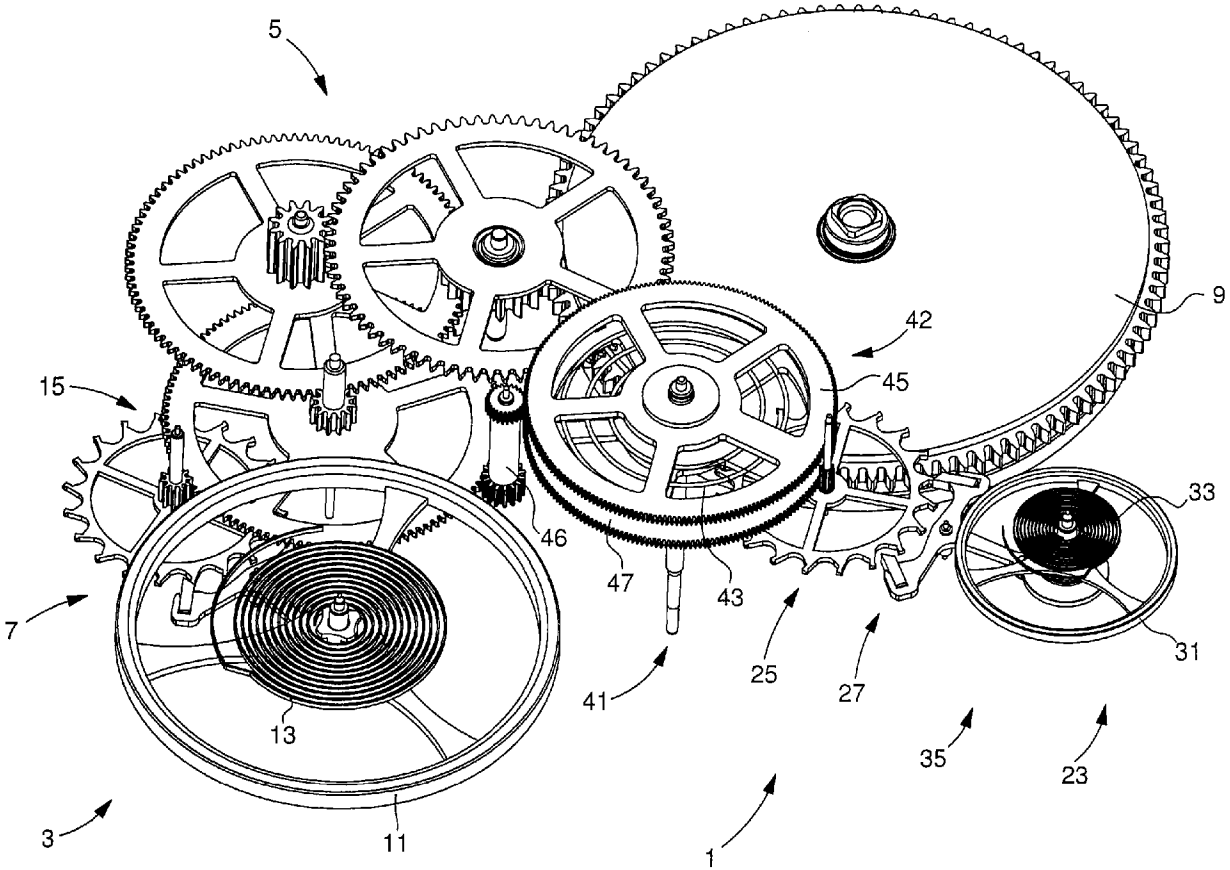
FIG. 1 is an example of a timepiece according to the invention.
Figure 2:
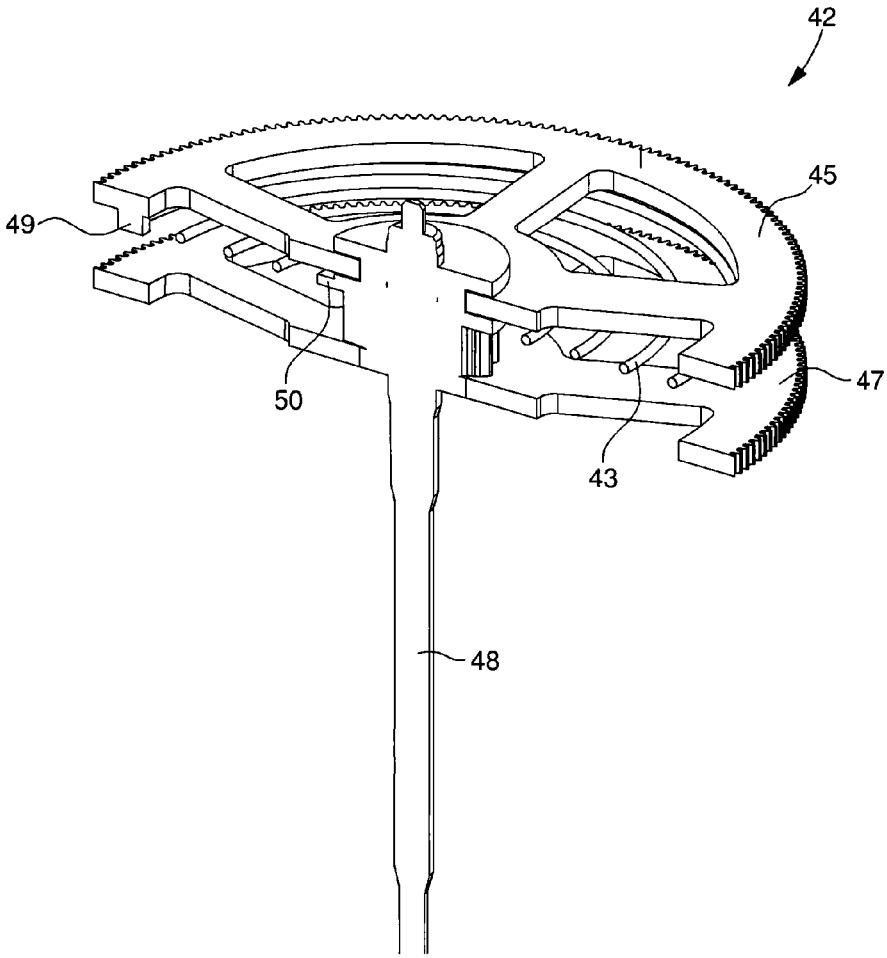
FIG. 2 is an example of elastic coupling means according to the invention.

As illustrated in FIGS. 1 and 2, the invention relates to a timepiece 1 including a first resonator 3 and connected by a first gear train 5 via a first escapement 7 to an energy source 9. The first resonator 3 and the first escapement 7 thus form a first oscillator 15 oscillating at a first frequency $f_1$. Timepiece 1 also includes a second resonator 23 connected to a second gear train 25 via a second escapement 27. The second resonator 23 and the second escapement 27 thus form a second oscillator 35 oscillating at a second frequency $f_2$.

Advantageously according to the invention, the second gear train 25 is permanently connected to first gear train 5 by an elastic coupling means 41 in order to synchronise the rate of the two oscillators 15, 35, using the same energy source 9. As seen in the example of FIG. 1, energy source 9 is preferably a barrel, i.e. a source of mechanical energy accumulation.

Preferably according to the invention, elastic coupling means 41 is formed by a spring 43 connecting one wheel of first gear train 5 to another wheel of second gear train 25. As illustrated in FIG. 2, preferably according to the invention, the elastic coupling means 41 connects the fourth wheels respectively of first gear train 5 and second gear train 25.

Preferably according to the invention, it is seen that a double wheel 42 is used. As shown more clearly in FIG. 2, it is formed by a first plate 45 connected via an intermediate wheel 46 to first gear train 5 and by a second plate 47 directly or indirectly connected to second gear train 25. The two plates 45, 47 are respectively loosely and fixedly secured to an arbour 48. Finally, spring 43 of elastic coupling means 41 is preferably mounted between the fastener 49 secured to the felloe of plate 45 and the collar 50 of arbour 48. It is thus clear that plates 45 and 47 and incidentally, gear trains 5 and 25, can be angularly shifted by the elastic coupling of spring 43.

Advantageously according to the invention, the time display, i.e. the hours, minutes and/or seconds, can be achieved either using the first or second gear train 5, 25.

Depending upon the desired application of the timepiece, the first $f_1$ and second $f_2$ frequencies may or may not be identical. Thus, in a first embodiment, the first and second frequencies $f_1$, $f_2$ are identical and preferably higher than 5 Hz for displaying the time with better resolution and/or better precision. In this embodiment, frequencies $f_1$, $f_2$ may, for example, be equal to 10 Hz or 50 Hz for displaying 1/20th or 1/100th of a second respectively.

Thus, depending upon the oscillator chosen as reference, it may be useful to mount the hour and minute display on the gear train of said oscillator selected as reference and the seconds display on the gear train of the second oscillator. Indeed, it has been observed that, when there is a shock, the seconds display may cause induced torque in the oscillator capable of changing the amplitude and rate of said oscillator.

In a second embodiment, the first frequency $f_1$ is higher than the second frequency $f_2$ so as to display the time with better resolution and/or better precision. In a similar manner to the first embodiment, the first frequency $f_1$ is at least equal to 10 Hz and the second frequency $f_2$ is preferably comprised between 1 and 5 Hz. Indeed, by way of example, it may be desired for a second to be incremented by a single step per second, i.e. second frequency $f_2$ is equal to 1 Hz, "like" a quartz watch.

In a third embodiment, the first frequency $f_1$ is lower than the second frequency $f_2$ so as to display the time with better resolution and/or better precision. In this embodiment, which is the reverse of the second embodiment, the same advantages are obtained.

Simulations were developed hereinafter to describe the synchronisation between these two oscillators 15 and 35. The third embodiment has been arbitrarily selected for the explanation. Thus, oscillator 15, which is selected as the reference, is of the low frequency type and is called the first oscillator. Consequently, in the example below, the second oscillator will be high frequency oscillator 35, which will be synchronised with low frequency oscillator 15.

Preferably according to the invention, the second oscillator 35 is selected with a strong anisochronism according to amplitude, described by the anisochronism slope $\Gamma$ and the amplitude $A_2^0$ at which the rate is zero. Moreover, since the first oscillator 15 is selected as the reference, it always has a substantially zero rate by slightly varying its amplitude.

The simulations show the change in the two oscillators 15, 35, i.e. their amplitude and state of phase difference with time, and thus mean that it can be checked whether or not it is possible to synchronise second oscillator 35 with first oscillator 15.

Preferably, second oscillator 35 is constructed so that its rate is zero when it oscillates at an amplitude $A_2^0$, positive when it oscillates at an amplitude higher than $A_2^0$ and negative when it oscillates at an amplitude lower than $A_2^0$.

Further, elastic coupling means 41 is devised so that the torque transmitted to second gear train 25 remains constant if the two gear trains 5, 25 are rotating at the same speed, decreases if second gear train 25 is advancing more quickly than first gear train 5 (spring 43 is letting down) and increases if second gear train 25 is advancing more quickly than first gear train 5 (spring 43 is being wound).

If the above conditions are satisfactory, the timepiece will always move towards the stable situation where second oscillator 35 oscillates at amplitude $A_2^0$ and in which spring 43 transmits to second gear train 25 the torque $M_2$ necessary to keep second oscillator 35 at amplitude $A_2^0$.

Consequently, if second oscillator 35 receives a torque lower than $M_2$, its amplitude decreases, i.e. it has an amplitude of less than $A_2^0$. As explained above, its rate becomes negative, i.e. second oscillator 35 falls behind first oscillator 5, selected as the reference.

It is thus clear that second gear train 25 will rotate more slowly than first gear train 5 while winding coupling spring 43, i.e. increasing the torque transmitted to second gear train 25. Consequently, since the torque is increasing, the amplitude of second oscillator 35 is automatically corrected. It is thus observed that the torque and amplitude of second oscillator 35 are structurally synchronised on the stable torque $M_2$ and stable amplitude $A_2^0$.

Similarly, if the torque received exceeds torque $M_2$, then the amplitude of second oscillator 35 becomes greater than value $A_2^0$, which means that the rate of second oscillator 35 will be positive. Second gear train 25 is then ahead of first gear train 5 while letting down spring 43. Consequently, the torque on second gear train 25 will decrease towards stable torque $M_2$, and the amplitude of second oscillator 35 will again tend towards stable amplitude $A_2^0$.

It is thus seen that regardless of the situation, whether it is when the watch is started, or after a shock, the system will always move towards stabilisation in the stable situation where the torque on second gear train 25 has a value $M_2$ and the amplitude of second oscillator 35 has a value of $A_2^0$.

Preferably according to the invention, it is assumed that the barrel torque 9 and the frequency $f_1$, $f_2$ of the two oscillators 15, 35 are given parameters. It is thus clear that the parameters still to be selected are:

- the "size" of the two oscillators 15, 35 (for example inertia blocks $I_1$, $I_2$ if resonators 3, 23 are of the sprung balance type);
- the quality factors of the two oscillators 15, 35: $Q_1$, $Q_2$ (which is a function of the size of the oscillator);
- the anisochronism slope of the second oscillator: $\Gamma$;
- the amplitude of the second oscillator at which its rate is zero: $A_2^0$;
- the torque $M_2$ of spring 43;
- the angular rigidity K of spring 43;

Preferably according to the invention, the parameters are selected as follows:

- a fraction of the total torque desired to be transmitted to the second oscillator, which gives the torque value $M_2$. According to the invention, the first oscillator 15 receives the most torque via energy source 9 and preferably at least 75% thereof;
- the amplitude $A_2^0$ at which the second oscillator is required to stabilise (therefore the second oscillator must be devised so that its rate is substantially zero at this amplitude);
- the size of the second oscillator (for example the inertia block) so that the stabilising amplitude is $A_2^0$ when it receives torque $M_2$ (via the quality factor);
- the size of the first oscillator (for example the inertia block) so that the stabilising amplitude is acceptable (via the quality factor);
- anisochronism slope $\Gamma$ of the second oscillator 35;
- rigidity K of spring 43.

Advantageously according to the invention, it is also preferred to "adjust" K and $\Gamma$ so that:

- the torque transmitted to gear train 25 never becomes zero;
- the rate of second oscillator 35 remains close to its zero frequency;
- the drift in state between the two oscillators 15, 35 is small at the "start up";
- the stabilising time is sufficiently short.

Empirically, it was demonstrated that it is preferable for the product K. $\Gamma$ to be kept identical in order to have the same stabilisation time in the continuing approximation. Thus, increasing K (and thus decreasing $\Gamma$ by the same amount) decreases the fluctuations in amplitude and torque (thus preventing the torque being cancelled out). However, this also increases the maximum state drift prior to stabilisation, and the instantaneous rate, which may become extreme. A compromise must therefore be found between these two effects.

It was also observed that increasing the frequency of the oscillator which is synchronised (second oscillator 35 above) decreases the stabilisation time. Finally, during tests, it was demonstrated that decreasing the quality factor of the oscillator which is synchronised (the second oscillator above) also decreases the stabilisation time.

Figure 3:
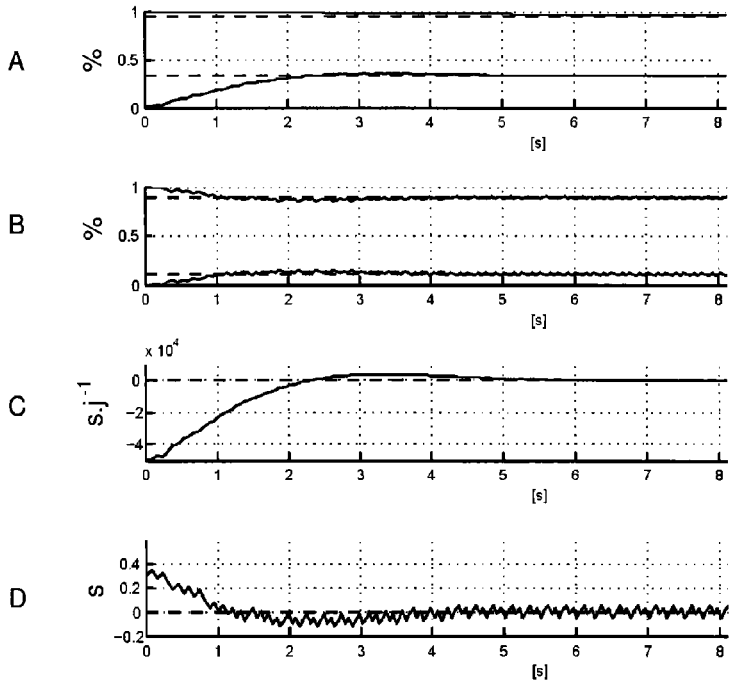
FIGS. 3 and 4 are synchronisation simulations for two example timepieces according to the invention.
Figure 4:
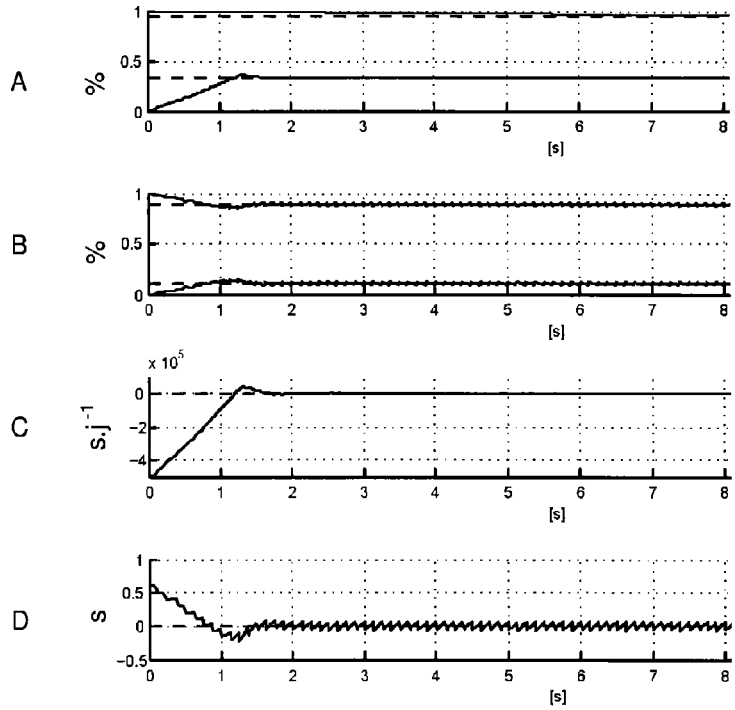

FIGS. 3 and 4 show simulations carried out by way of example implementation. In FIG. 3, $f_1$=4 Hz, $f_2$=10 Hz, $Q_1$=200, $Q_2$=50 and, in FIG. 4, $f_1$=4 Hz, $f_2$=50 Hz, $Q_1$=200, $Q_2$=50 with an identical product K. $\Gamma$ for each simulation.

Part A of each Figure corresponds to the fraction of amplitude of each oscillator relative to the reference amplitude if it received all of the torque from the energy source. It is to be noted that for the examples in the Figures, the amplitude $A_2^0$ chosen for the second oscillator is approximately ⅓. Thus, after 2 and 1.5 seconds respectively, each oscillator is stabilised at its synchronised amplitude.

Part B of each Figure corresponds to the fraction of torque that each oscillator receives from the energy source. It is to be noted that for the examples in the Figures, the proportion of torque chosen for the second oscillator is around 10%. Thus, after 2 and 1.5 seconds respectively, each oscillator receives its proportion of torque in a stabilised manner.

Part C of each Figure corresponds to the rate of the second oscillator. It is to be noted therefore that after 5.5 and 2 seconds respectively, the second oscillator is stabilised around its zero rate.

Finally, part D of each Figure corresponds to the difference in state in seconds between each oscillator. It is therefore to be noted that after 5 and 2 seconds respectively, the difference is stabilised at its zero value.

Parts A-D of FIGS. 3 and 4 therefore illustrate perfectly the conclusions set out above. It is therefore clear that, in the event of shocks, rate variations will be minimal owing to the construction which allows the two oscillators to be synchronised. Consequently, the timepiece according to the invention is capable of displaying the time with better resolution and/or better precision while ensuring a high level of robustness, low power consumption and minimal drift between the gear trains 5, 25.

Moreover, during tests, it was discovered that not only did the first oscillator selected as the reference preferably have better quality isochronism than the second oscillator so as to facilitate synchronisation of said second oscillator, but the second oscillator preferably has a lower quality factor than the first oscillator, preferably lower than 100, so as to obtain more rapid stabilisation, i.e. typically less than 2 seconds.

Of course, this invention is not limited to the illustrated example but is capable of various variants and alterations that will appear to those skilled in the art. In particular, the oscillator selected as the reference may equally well be either first oscillator 15 or second oscillator 35, since the conclusions relating respectively to the first oscillator and second oscillator will not change.

Thus, to invert the above example, the oscillator selected as the reference could be second oscillator 35, selected with a high frequency so as to form a precision timepiece. In this case, the time display will preferably be achieved using the first gear train 5 of the first oscillator chosen at low frequency to limit the propagation of torque induced by any shock to the second, high frequency oscillator 35.

Moreover, the oscillator which preferably has a frequency at least equal to 10 Hz, may be a Clifford oscillator (see for example CH Patent No. 386344 incorporated herein by reference) instead of the oscillator disclosed above. Further, the oscillator, which has a frequency comprised between 1 and 5 Hz, will preferably be of the sprung balance type and have a Swiss lever escapement.

Of course, elastic coupling means 41 is not limited to a double wheel 42 cooperating with a spring 43, as illustrated in FIGS. 1 and 2. Other elastic coupling means may be envisaged, for example those disclosed in patent document PCT/EP2011/061244 which is incorporated herein by reference.

Advantageously according to the invention, it is clear that the timepiece may thus structurally include a display for a value of less than a second permanently or non-permanently secured (i.e. via a coupling) to gear train 5, 25 which has a high frequency oscillator. Thus the value could be as low, for example, as 1/20th of a second, if the oscillator beats at at least 10 Hz, or 1/100th of a second if the oscillator beats at at least 50 Hz. The timepiece may even comprise a disconnectable chronograph system, also secured to the first or second gear trains 5, 25.

Finally, it is possible to further optimise the behaviour of the system if the anisochronism of the second oscillator is non-linear. By way of example, the second oscillator may have a low anisochronsim around the amplitude of equilibrium and a strong anisochronism far from the amplitude of equilibrium, or vice versa.

What is claimed is:

1. A timepiece comprising:

a first oscillator oscillating at a first frequency and connected by a first gear train to an energy source, said first oscillator comprising a first resonator connected to a first escapement; and a second oscillator oscillating at a second frequency and connected to a second gear train, said second oscillator comprising a second resonator connected to a second escapement, wherein the second gear train is connected to the first gear train by an elastic coupling device configured to synchronize the rate of the two oscillators using the same energy source.

2. The timepiece according to claim 1, wherein the elastic coupling device is formed by a spring connecting one wheel of the first gear train to another wheel of the second gear train.

3. The timepiece according to claim 2, wherein the elastic coupling device connects the fourth wheels respectively of the first gear train and the second gear train.

4. The timepiece according to claim 1, wherein one of said first and second oscillators is a reference oscillator and the reference oscillator receives the most torque from the energy source.

5. The timepiece according to claim 4, wherein the reference oscillator receives at least 75% of the torque supplied by the energy source.

6. The timepiece according to claim 1, wherein one of said first and second oscillators is a reference oscillator and the reference oscillator has better quality isochronism than the other oscillator to facilitate the synchronisation of said other oscillator.

7. The timepiece according to claim 1, wherein one of said first and second oscillators is a reference oscillator and the reference oscillator has a higher quality factor than the other oscillator.

8. The timepiece according to claim 7, wherein said other oscillator has a quality factor of less than 100 so as to obtain more rapid stabilisation.

9. The timepiece according to claim 1, wherein the first and second frequencies are identical.

10. The timepiece according to claim 9, wherein the two frequencies are higher than 5 Hz so as to display the time with better resolution and/or better precision.

11. The timepiece according to claim 1, wherein the first frequency is different from the second frequency to change the resolution and/or improve precision.

12. The timepiece according to claim 11, wherein one of the two frequencies is at least equal to 10 Hz and the other frequency is between 1 and 5 Hz.

13. The timepiece according to claim 1, wherein one of said first and second oscillators is a reference oscillator and the reference oscillator is the second oscillator.

14. The timepiece according to claim 1, wherein one of said first and second oscillators is a reference oscillator and the reference oscillator is the first oscillator.

15. The timepiece according to claim 1, wherein further comprising a disconnectable chronograph system integral with one of the gear trains.

16. The timepiece according to claim 1, wherein further comprising a display with a value lower than a second, permanently or non-permanently secured to one of the gear trains.

* * * * *